United States Patent [19]

Richard et al.

[11] 4,378,782

[45] Apr. 5, 1983

[54] CERAMIC TILE CUTTER

[75] Inventors: Schotter D. Richard, Glenwood; Robert P. Heinis, Totowa, both of N.J.

[73] Assignee: Red Devil Inc., Union, N.J.

[21] Appl. No.: 259,420

[22] Filed: May 1, 1981

[51] Int. Cl.[3] ..... B28D 1/32

[52] U.S. Cl. ..... 125/23 T; 225/96.5

[58] Field of Search ..... 125/23 R, 3, 23 T; 225/96.5

[56] References Cited

U.S. PATENT DOCUMENTS

| | | | |
|---|---|---|---|
| 600,856 | 3/1898 | Brinkman | 125/3 |
| 1,873,721 | 8/1932 | Postley . | |
| 1,932,659 | 10/1933 | Granite . | |
| 1,995,741 | 3/1935 | Granite . | |
| 2,246,351 | 6/1941 | Engleke . | |
| 2,541,708 | 2/1951 | Marus . | |
| 3,570,734 | 3/1971 | Allen | 225/96.5 |
| 4,026,262 | 5/1977 | Yasuga . | |
| 4,192,282 | 3/1980 | Fischer | 125/23 T |

FOREIGN PATENT DOCUMENTS

| | | | |
|---|---|---|---|
| 67404 | 8/1948 | Denmark | 125/23 T |

*Primary Examiner*—Harold D. Whitehead
*Attorney, Agent, or Firm*—A. F. Kronman

[57] ABSTRACT

A tile scoring and fracturing device in which spaced parallel links swingably secured at one end to a base and freely secured at their other ends to the ends of an elongated guide bar to form a rectangular assembly can be shifted to a parallelogram configuration to lower the guide bar toward a tile placed upon the base. A combined tile scoring and fracturing head is slidably carried upon the guide bar. In the rectangular mode the scoring and fracturing head is used to score the tile along a predetermined path. Thereafter, as the links and guide bar are shifted to the parallelogram configuration the tile is fractured by the said head.

7 Claims, 4 Drawing Figures

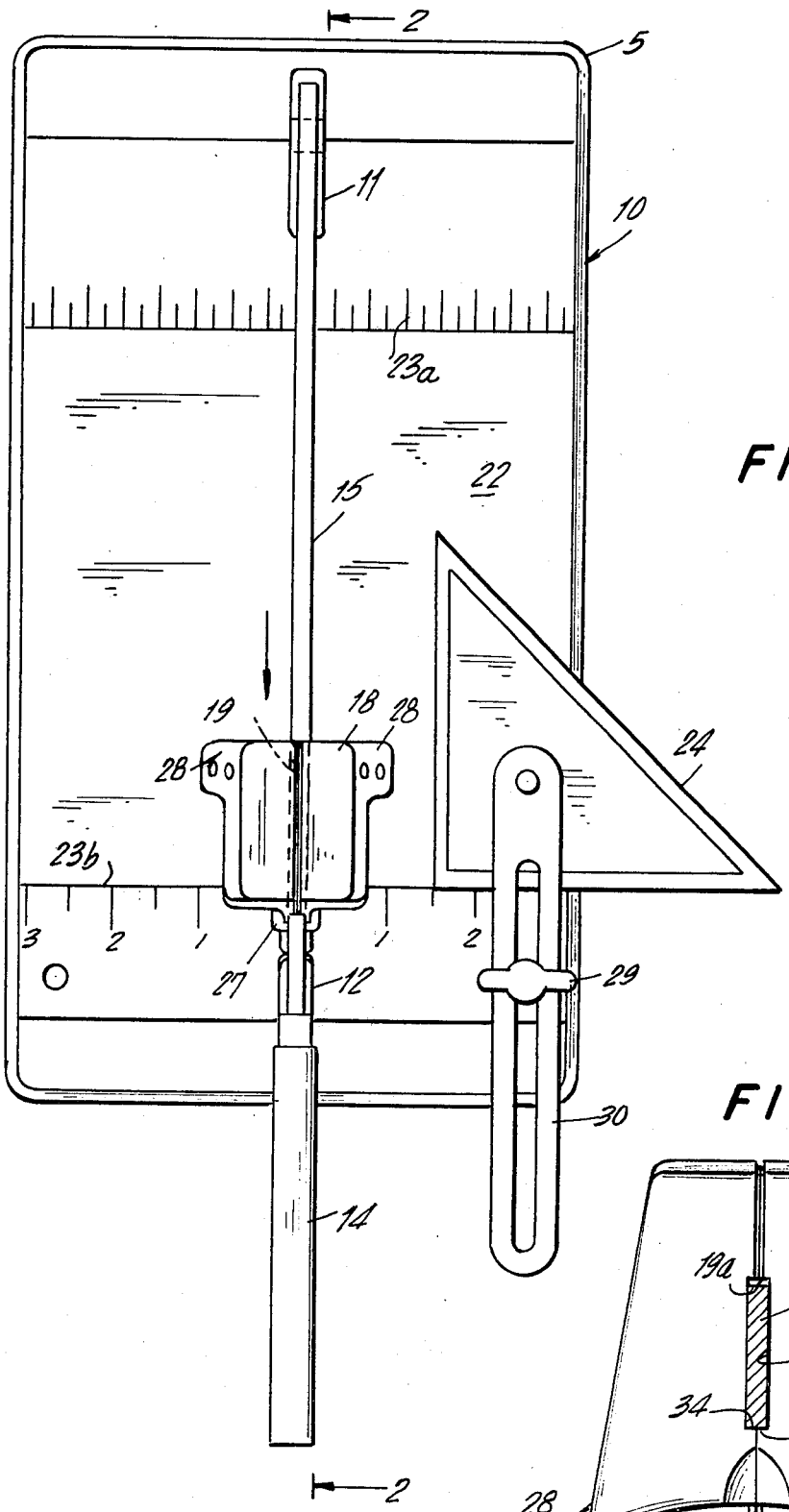
FIG. 1
FIG. 4
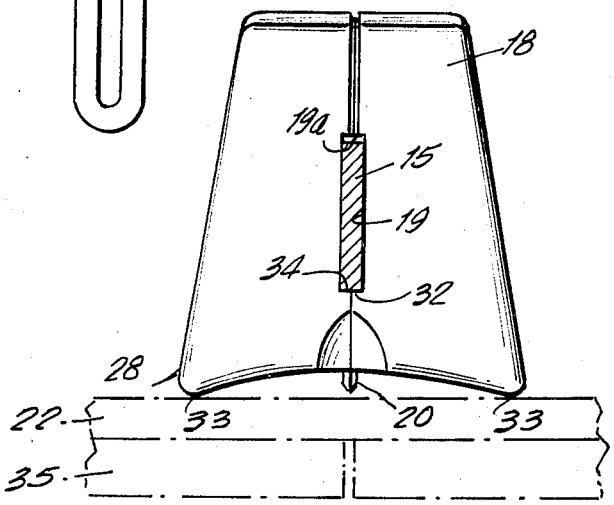

CERAMIC TILE CUTTER

BACKGROUND OF THE INVENTION

This invention relates to tile cutters and more specifically to cutters for ceramic tiles having one glazed major surface.

Cutting ceramic tiles to a desired size or shape is usually accomplished by first scoring the glazed surface of the tile with a wheel, disc, or blade well-known in the glass and ceramic cutting arts and thereafter applying pressure to the surface of the tile to cause the tile to fracture along the score line.

It is well-known to provide a tile cutter consisting of a yieldable support for the tile and a horizontal beam on which there is carried a cutting wheel to score a tile. An additional arm is provided to press against the top of the scored tile to cause it to fracture along the scored line. Such devices are shown in the patents issued to Engleke, U.S. Pat. No. 2,246,351 and Marus, No. 2,541,708. The penetration of the cutter in the direction of the tile is restricted in these patents by means of an adjustable screw acting as a stop. Other patents such as Postley, U.S. Pat. No. 1,873,721 and Fischer, No. 4,192,282, employ lateral fins or breaker arms secured to a handle which also holds the cutting tool to fracture the tile. The handles are l-shaped so that the breaker arms can be swung out of the way while the cutting tool is in operation and vice versa.

In order to reliably fracture a scored tile it is important that the breaker arms or their equivalent bear against the tile with a substantial bearing area and in a direction normal to the surface of the tile. When different thicknesses of tile are cut in the same device the Postley and Fischer patents do not fulfill these requirements. Other prior art devices such as the patents issued to Granite, U.S. Pat. Nos. 1,932,659 and 1,995,741 employ bell crank levers for bringing the cutting wheel into contact with the surface of the tile and thereafter bringing the breaking arm to bear against the tile surface. These structures are difficult from the standpoint of inserting and adjusting the tile positions and also in bringing the breaker arm into its proper position for dependable tile fracturing.

The present invention employs a simple linkage arrangement which shifts from a rectangular configuration during the scoring step to a paralelogram shape for tile breaking. The mere change in this position of the linkage automatically removes the cutting wheel or tool from the plane of the tile and presents the pressure member against the tile in the optimum position for various tile thicknesses.

SUMMARY OF THE INVENTION

In the present invention there is provided a base having a table on top of which is carried a resilient pad. At each end of the base there are upstanding links swingably secured to the base at one end. An elongated horizontal guide bar is freely secured at each end to the free end of each link. A tile scoring head is slidably carried upon the guide bar and supports a cutting tool and tile fracturing bearing surfaces at its lower end. A handle connected to one of the upstanding links can change the position of the horizontal bar vertically by swinging the links from a vertical orientation to an angular orientation while at the same time bringing the cutting head down upon the tile which has been scored. As the breaking surface of the cutting head comes into contact with the face of the tile its shape causes the cutting head to swing into position whereby the bearing surfaces of the tile fracturing portion come into precise contact with the surface of the tile. This highly simplified construction eliminates the need for adjusting members, gives automatic orientation to the tile fracturing structure and is adaptable to a wide variety of tile thicknesses.

BRIEF DESCRIPTION OF THE DRAWINGS

In the accompanying drawings forming part hereof, similar elements have been given the same reference numerals in which drawings:

FIG. 1 is a plan view of a ceramic tile cutter made in accordance with the present invention.

FIG. 4 is an end view taken on line 4—4 of FIG. 3.

DETAILED DESCRIPTION

Figure 2:
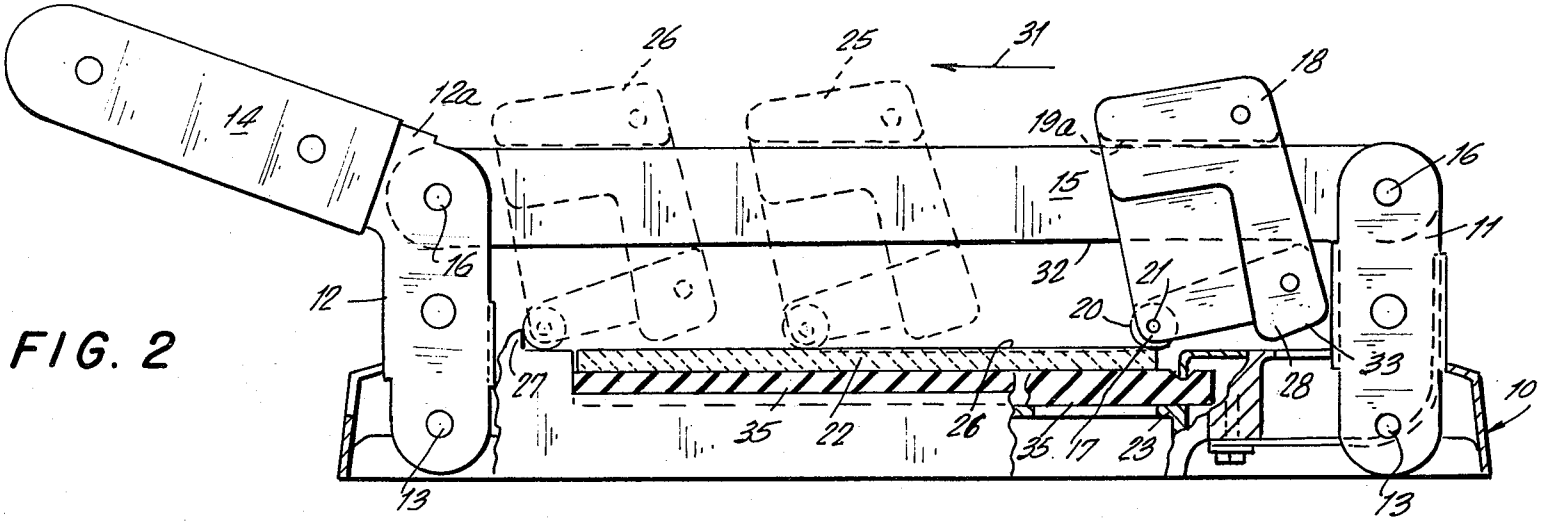
FIG. 2 is a view in side elevation taken on line 2—2 in FIG. 1 of the tile cutter indicating the steps of scoring the tile.
Figure 3:
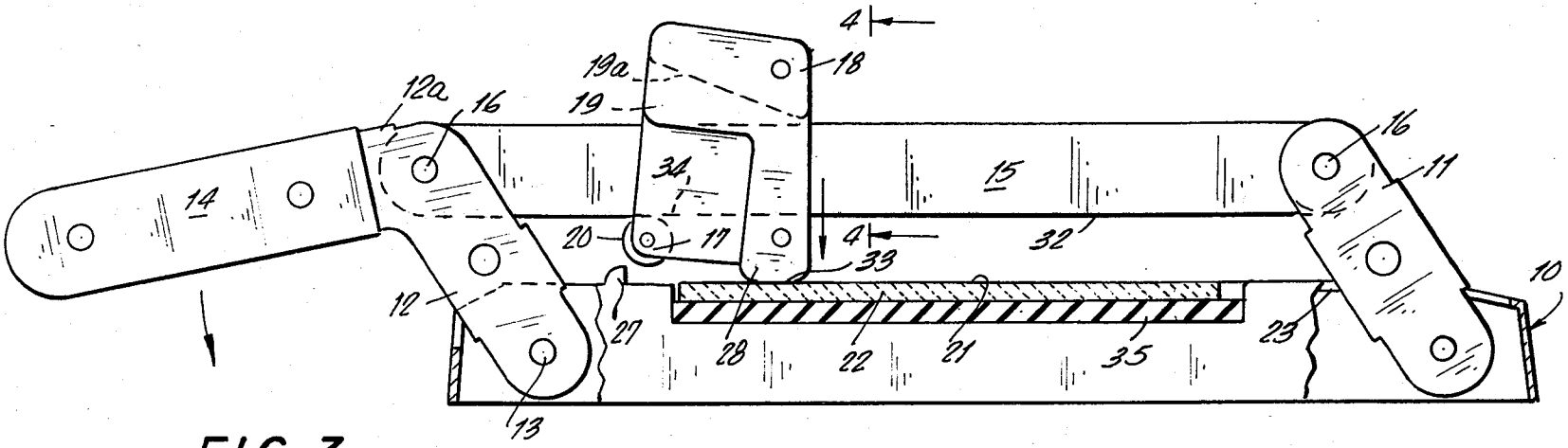
FIG. 3 is a view similar to FIG. 2 showing the tile cutter in the tile fracturing position.

Referring to the drawings there is shown a ceramic tile cutter 5 having a base 10 to which there is pivotally secured a first link 11 adjacent one end of the base and a second link 12 adjacent the opposite end of the base. As best shown in FIGS. 2 and 3, the links 11, 12 are swingably secured to the base by pins 13. The link 12 is off-set as indicated at **12*a* and extended in the form of a handle 14**.

A horizontal guide bar 15 is freely secured at each of its ends to the links 11, 12 by pivot pins 16. A tile scoring head 18 having a somewhat trapezoidal shape and formed with an internal slot 19 for a substantial portion of its length, straddles the guide bar 15 and is slidable thereon.

The tile scoring head may be made in two complimentary sections for ease in manufacture as best shown in FIGS. 1 and 4.

As best shown in FIGS. 2 and 3, the top of the slotted portion 19 forms an upper bearing surface **19*a* which may ride upon the top of the guide bar 15 when the tile scoring head is in the cutting position. A corner 17 formed at one end of the bottom portion of the scoring head 18 receives a cutting tool such as a carbide wheel 20, a turret assembly of carbide wheels (not shown) or any other cutting tool which will score the glazed surface of a tile in the well-known manner. The wheel 20 is securely journaled in the tile scoring head as indicated by the axle 21**.

The base 10 is provided with a table 23 upon which there are placed two resilient pads 35 made of foamed plastic, natural or synthetic rubber such as Neoprene or the like. The pads 35 are spaced from each other along the path of travel of the wheel 20. The tile 22 which is to be cut is placed upon the pads 24 in the manner shown in FIGS. 2 and 3.

As best shown in FIG. 1, a tile orienting member is provided upon the table 23 such as the adjustable triangle 24. In addition, there are provided scales **23*a* and 23*b*. By means of a simple wing nut 29 cooperating with an elongated slotted arm 30 the tile 22** may be placed in any position required for scoring.

When it is desired to cut or fracture a tile it is placed upon the table pad 35 in the required position. Starting with the tile scoring head 18 in the forward location as shown at the right in FIG. 2, the operator grasps the top of the tile scoring head and brings the cutting tool 20 into scoring contact with the glazed surface of the tile. At this juncture the score line 26 has been completed.

The operator next grasps the handle 14 and swings it from the position shown in FIG. 2, to that shown in FIG. 3. The upstanding links 11, 12 are thereby swung from their vertical position into a parallel angular orientation to form the parallelogram-like arrangement of FIG. 3. As a result of the movements of the links, the guide bar 15 is lowered without disturbing its horizontal position. The bottom edge 32 of the guide bar comes into contact with the bottom bearing surface 34 within the slot 19 of the tile scoring head 18. Since the upper bearing surface 19*a* and the bottom bearing surface 34 diverge in the direction of the travel of the tile cutting head the bottom bearing surface 33 of the scoring head is angularly disposed with respect to the tile 22 at the end of the scoring operation as shown in FIG. 2. Tile fracturing leg portions 28 on the scoring head 18 diverge and extend from the bottom of the tile scoring head on each side thereof as best shown in FIGS. 2–4. The legs 28 are in an elevated position clear of the surface of the tile 22 at the end of the scoring operation. As the guide bar 15 is lowered, however, the bottom edge of the bar comes into contact with the upper portion of the angularly disposed bottom bearing surface 34 of the slot 19 causing the tile scoring head 18 to rotate and also bringing the tile fracturing legs 28 into contact with the surface of the tile. The legs 33 further cause the tile cutting head to rotate until the longitudinal faces 33 which lie in a plane parallel to the bottom bearing surface 34 in the slot 19 on the bottom of the tile scoring head 18 are in good contact with the surface of the tile as shown in FIG. 3. At this juncture, the cutting tool 20 is automatically elevated from the table so that it is not damaged by the further downward pressure of the handle 14 which in turn causes the tile fracturing legs 36 to break the tile along the score line 26.

The shift of the links 11, 12 and the guide bar 15 from their rectangular to the parallelogram configuration provides a greater mechanical advantage when it is needed, as in fracturing thick tiles, due to the elevated position of the handle 14 at the start of the fracturing operation in breaking the thicker tiles.

Having thus fully described the invention, what is desired to be claimed and secured by Letters Patent is:

1. A tile scoring and fracturing device comprising a base, a resilient tile receiving member on said base, spaced links swingably secured to the base at opposed ends thereof and extending upwardly from said base, an elongated guide bar having a top and a bottom edge, said guide bar being freely coupled at each end to one of the free ends of the links, a tile scoring head slidably carried by the guide bar, a slot in said head to receive the bar therethrough, a top and a bottom bearing surface in said slot, a tile scoring member carried by the tile scoring head adjacent the surface of the resilient tile receiving member, tile fracturing legs on each side of the tile scoring head extending from the tile scoring head in the direction of the resilient tile receiving member, means coupled to the links to swing the said links through an arc about their base secured portion whereby the bottom edge of the guide bar acting against the bottom bearing surface of the tile scoring head slot rotates said scoring head to bring the tile fracturing legs into forcible contact with a scored tile.

2. A device according to claim 1 in which the spaced links are substantially parallel to each other and the guide bar is substantially parallel to the base at all times.

3. A device according to claim 1 in which the link swinging means comprises a handle operatively connected to one of the links.

4. A device according to claim 3 in which the top and bottom bearing surfaces in the slot are divergent in the direction of the path of the tile cutting head.

5. A device according to claim 1 in which the tile fracturing legs are formed with flat bearing surfaces at the bottom thereof disposed in a plane substantially parallel to the bottom bearing surface within the slot.

6. A device according to claim 1 in which the base is provided with a fixed stop disposed in the path of the tile scoring member to limit the travel of said scoring member.

7. A device according to claim 1 in which the tile scoring member is a glass cutting wheel.

* * * * *